US010907629B2

(12) United States Patent
Teshima et al.

(10) Patent No.: US 10,907,629 B2
(45) Date of Patent: Feb. 2, 2021

(54) DIAPHRAGM PUMP HAVING AN ACTUATOR DRIVEN BY A CONTROLLER TO MOVE A DIAPHRAGM OR A MOVABLE MEMBER TO BRING A MOTOR INTO A FIRST STEP-OUT WHEREIN AN ORIGIN POSITION IS RESET

(71) Applicant: NIPPON PILLAR PACKING CO., LTD., Osaka (JP)

(72) Inventors: Kazukiyo Teshima, Osaka (JP); Naoto Yamada, Osaka (JP); Motoaki Naruo, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 257 days.

(21) Appl. No.: 16/304,186

(22) PCT Filed: Jun. 15, 2017

(86) PCT No.: PCT/JP2017/022137
§ 371 (c)(1),
(2) Date: Nov. 23, 2018

(87) PCT Pub. No.: WO2018/008353
PCT Pub. Date: Jan. 11, 2018

(65) Prior Publication Data

US 2020/0318632 A1 Oct. 8, 2020

(30) Foreign Application Priority Data

Jul. 4, 2016 (JP) ..... 2016-132419

(51) Int. Cl.
*F04B 49/06* (2006.01)
*F04B 43/04* (2006.01)

(52) U.S. Cl.
CPC ..... *F04B 49/06* (2013.01); *F04B 43/04* (2013.01); *F04B 2201/0201* (2013.01); *F04B 2201/0209* (2013.01); *F04B 2203/02* (2013.01)

(58) Field of Classification Search
CPC ..... F04B 49/02; F04B 49/00; F04B 43/00; F04B 17/03; F04B 34/04; F04B 49/065; F04B 49/01; F04B 2201/0201; F04B 2201/0206; F04B 2201/0209; F04B 2203/02; H02P 25/066
(Continued)

(56) References Cited

FOREIGN PATENT DOCUMENTS

JP 2007-23935 A 2/2007
JP 2008-169863 A 7/2008
(Continued)

OTHER PUBLICATIONS

Combined Chinese Office Action and Search Report dated Jun. 30, 2020, in Patent Application No. 201780033769.5 (with English translation), 15 pages.
(Continued)

*Primary Examiner* — Devon C Kramer
*Assistant Examiner* — Benjamin Doyle
(74) *Attorney, Agent, or Firm* — Oblon, McClelland, Maier & Neustadt, L.L.P.

(57) ABSTRACT

A diaphragm pump includes a reciprocable diaphragm, an actuator including a motor, and a control device. The control device resets an origin of the diaphragm in a reciprocating direction, when detecting a step-out of the motor. After resetting the origin, the control device activates the actuator to move the diaphragm to the origin.

4 Claims, 8 Drawing Sheets

(58) Field of Classification Search
USPC ..... 417/44.1, 44.11, 63; 310/15, 17, 19, 310/27–33; 318/119–134
See application file for complete search history.

(56) References Cited

FOREIGN PATENT DOCUMENTS

| | | | |
|---|---|---|---|
| JP | 2013-172527 | A | 9/2013 |
| JP | 2015-223269 | A | 12/2015 |
| JP | 2016-61169 | A | 4/2016 |

OTHER PUBLICATIONS

International Search Report dated Aug. 15, 2017 in PCT/JP2017/022137 filed Jun. 15, 2017.

DIAPHRAGM PUMP HAVING AN ACTUATOR DRIVEN BY A CONTROLLER TO MOVE A DIAPHRAGM OR A MOVABLE MEMBER TO BRING A MOTOR INTO A FIRST STEP-OUT WHEREIN AN ORIGIN POSITION IS RESET

TECHNICAL FIELD

The present invention relates to a diaphragm pump.

BACKGROUND ART

A diaphragm pump is known as a volumetric reciprocating pump for transferring fluid such as chemical liquid (e.g., see Patent Document 1). The diaphragm pump is often used when a high discharge accuracy is required in fluid transfer, for example, in manufacture of semiconductors, liquid crystals, organic electroluminescence (EL) devices, solar cells, or light-emitting diodes (LED).

The diaphragm pump of this type is provided with a housing, a diaphragm, an actuator, and a detector. The diaphragm is disposed to forma pump chamber in the housing, and reciprocable with respect to an origin to change the volume of the pump chamber.

The actuator is configured to reciprocate the diaphragm. The detector is configured to detect the origin of the diaphragm (a reference position of a piston). For ensuring the discharge accuracy, returning the diaphragm to the origin is performed based on the detection result of the detector.

Since the above-mentioned diaphragm pump sets the origin detected by the detector as the reference position of the piston, the pump has risk of slightly fluctuating the discharge accuracy among products depending on mounting accuracy of the detector or processing accuracy of the housing. In addition, need for preparing and installing the detector in the housing or the like increases manufacturing costs of the diaphragm pump.

PRIOR ART DOCUMENT

Patent Document

Patent Document 1: Japanese Unexamined Patent Application Publication No. 2007-023935

SUMMARY OF THE INVENTION

The present invention has been made in view of the above-described circumstances, and an object of the present invention is to provide a diaphragm pump capable of enhancing discharge accuracy in fluid transfer and reducing manufacturing costs.

According to an aspect of the present invention, a diaphragm pump for transferring a fluid includes: a housing that accommodates a stationary member; a diaphragm disposed to form a pump chamber in the housing, and reciprocable with respect to an origin to change the volume of the pump chamber; an actuator including a motor as a driving source and a movable member interlocked with the diaphragm, and configured to reciprocate the diaphragm; and a control device for controlling the actuator to reciprocate the diaphragm. The control device is configured to detect a first step-out of the motor, drive the actuator to move the diaphragm or the movable member until it hits the housing or the stationary member to bring the motor into the first step-out, and reset a position as the origin, when detecting the first step-out of the motor. The position is a predetermined distance in a reciprocating direction of the diaphragm from a position at which the diaphragm or the movable member hits the housing or the stationary member. The control device is configured to activate the actuator after resetting the origin, to move the diaphragm to the origin.

This configuration enables the diaphragm to more accurately return to the origin before the fluid transfer is started using the diaphragm pump, which is peculiar to the diaphragm pump. Hence, the diaphragm pump can enhance the discharge accuracy in fluid transfer. Further, the detector for returning the diaphragm to the origin is unnecessary. This enables reduction in manufacturing costs of the diaphragm pump.

The motor may be a stepping motor.

The control device may be configured to grasp a position of the diaphragm in the reciprocating direction, and stop the actuator, when determining, from the position of the diaphragm, that the diaphragm moves forward beyond a first predetermined amount or backward beyond a second predetermined amount.

The diaphragm pump may include an alarm device that issues an alarm when the actuator is stopped.

According to the present invention, it is possible to provide a diaphragm pump capable of enhancing discharge accuracy in fluid transfer and reducing manufacturing costs.

DESCRIPTION OF THE EMBODIMENTS

An embodiment of the present invention will be described with reference to the drawings.

Figure 1:
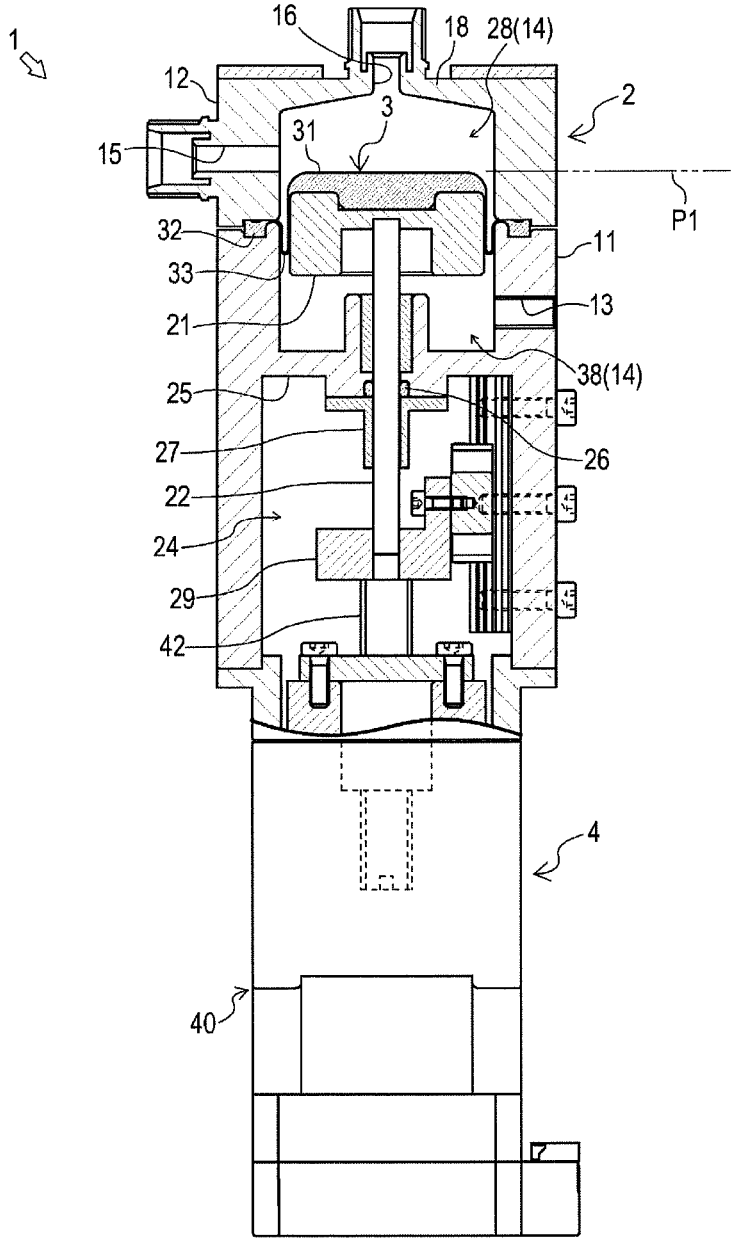
FIG. 1 is a side sectional view of a diaphragm pump according to an embodiment of the present invention, showing a state of the diaphragm pump after completion of a discharge.
Figure 2:
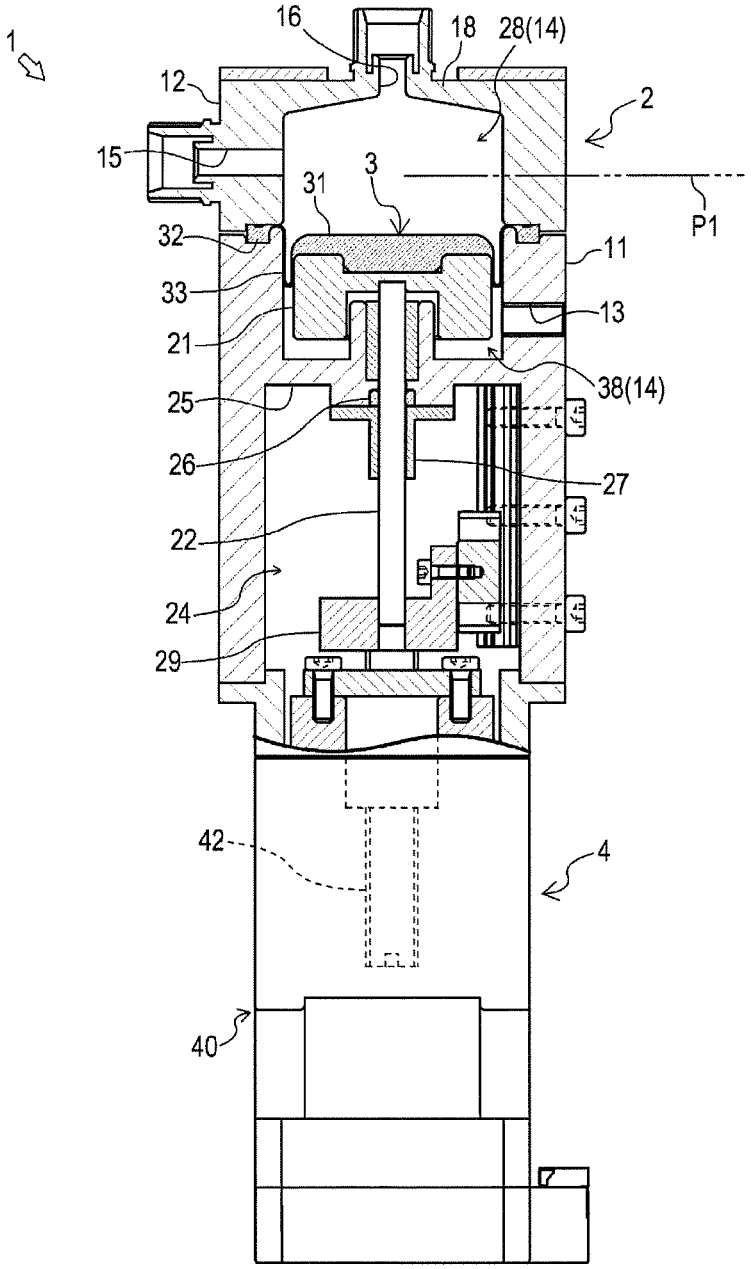
FIG. 2 is a side sectional view showing a state of the diaphragm pump of FIG. 1 after completion of a suction.

A diaphragm pump 1 according to the embodiment of the present invention is a volumetric reciprocating pump for transferring fluid such as chemical liquid. As shown in FIGS. 1 and 2, the diaphragm pump 1 includes a housing 2, a diaphragm 3, an actuator 4, and a control device 5.

In the following description, a back-and-forth direction refers to the vertical direction on the drawings, advance refers to forward movement, and retreat refers to backward movement.

The housing 2 accommodates a stationary member and a movable member. In the present embodiment, the housing 2 has an internal space, in which the stationary member is disposed and provided to keep stationary with respect to the housing 2. Examples of the stationary member include an O-ring retainer 27 described later.

The housing 2 includes a cylinder 11 and a pump head 12. The cylinder 11 is made of stainless steel such as SUS 304. The cylinder 11 has a circular-cylindrical shape and is disposed such that its axial direction is the back-and-forth direction.

The cylinder 11 has a vent hole 13. The vent hole 13 is provided in a side portion of the cylinder 11 to penetrate in a direction intersecting with the axial direction of the cylinder 11. The vent hole 13 can be connected to a decompressor (not shown) such as a vacuum pump or an aspirator.

The pump head 12 is made of, for example, a fluororesin such as polytetrafluoroethylene (PTFE). The pump head 12 has a covered-cylindrical shape with substantially the same inner diameter as the cylinder 11, and is disposed coaxially with the cylinder 11.

The pump head 12 is attached to one axial end (front end) of the cylinder 11 to close an opening on one axial side (front side) of the cylinder 11. As a result, a first internal space 14 surrounded by the cylinder 11 and the pump head 12 is formed in the housing 2.

The pump head 12 has a suction port 15 and a discharge port 16. The suction port 15 is provided to penetrate a side portion of the pump head 12 in a direction intersecting with the axial direction of the pump head 12. The suction port 15 is connected to predetermined equipment (not shown) serving as a fluid supply source via an on-off valve on the suction side, piping, and the like.

The discharge port 16 is provided to penetrate one axial end (front end) of the pump head 12, namely, a lid portion 18 in the axial direction of the pump head 12. The discharge port 16 is disposed at a radially-center part of the lid portion 18, and is connected to predetermined equipment (not shown) serving as a fluid supply source via an on-off valve on the discharge side, piping, and the like.

The actuator 4 is configured to reciprocate the diaphragm 3. In the present embodiment, the actuator 4 includes a piston 21 and a shaft 22, which are movable members. The piston 21 and the shaft 22 are reciprocable in the housing 2.

The piston 21 is made of, for example, an aluminum alloy. The piston 21 has a cylindrical shape including a recess, and is disposed coaxially with the housing 2 (the cylinder 11). The piston 21 is accommodated in the first internal space 14 of the housing 2.

The piston 21 is provided to generate a clearance between the piston 21 and an inner wall of the housing 2 (the cylinder 11 and the pump head 12), and is reciprocable along the inner wall of the housing 2 in the axial direction of the housing 2 (the back-and-forth direction).

The shaft 22 is made of, for example, steel such as quenched high-carbon chromium bearing steel. The shaft 22 is disposed coaxially with the piston 21 and is axially-reciprocable to penetrate a partition 25 via an O-ring 26; the partition 25 divides the interior of the housing 2 into the first internal space 14 and a second internal space 24.

The O-ring 26 is held on the partition 25 by the O-ring retainer 27. The O-ring retainer 27 is a stationary member accommodated in the housing 2 and is made of, for example, stainless steel. The O-ring retainer 27 is disposed in the second internal space 24 of the housing 2, while causing the shaft 22 to penetrate without contact with the O-ring retainer 27.

The shaft 22 has one axial end (front end) located in the first internal space 14 and the other axial end (back end) located in the second internal space 24. The shaft 22 is connected to the piston 21 at the one axial end to be reciprocated integrally with the piston 21.

The actuator 4 also includes, as the movable member, a shaft holder 29 for holding the shaft 22 in the housing 2. The shaft holder 29 is made of, for example, stainless steel. The shaft holder 29 is disposed in the second internal space 24 of the housing 2 and is provided to couple between the shaft 22 and an output shaft 42 described later.

The diaphragm 3 is disposed to form a pump chamber 28 in the housing 2, and is reciprocable with respect to an origin P1 to change the volume of the pump chamber 28. The diaphragm 3 is a rolling diaphragm.

In the present embodiment, the diaphragm 3 is made of, for example, fluororesin such as polytetrafluoroethylene (PTFE). The diaphragm 3 has a center part having a covered cylindrical shape, and is provided to cover one axial side (front side) of the piston 21 with the center part.

The diaphragm 3 includes an abutment portion 31, a holding portion 32, and a folded portion 33. The abutment portion 31 constitutes a lid part of the diaphragm 3, which is attached to the piston 21 to face the pump chamber 28 to be opposed to one axial end (ceiling portion) of the housing 2, namely, the lid portion 18.

The holding portion 32 is disposed at an outer peripheral end of the diaphragm 3 located radially outside the abutment portion 31 and is sandwiched between the cylinder 11 and the pump head 12. The folded portion 33 has flexibility and is deformably provided between the abutment portion 31 and the holding portion 32.

The holding portion 32 fixes the diaphragm 3 on the housing 2 such that the diaphragm 3 can deform the folded portion 33 between the inner wall of the housing 2 and the piston 21, and change the axial position of the abutment portion 31, to be reciprocated integrally with the piston 21.

The diaphragm 3 also partitions the first internal space 14 of the housing 2 into the pump chamber 28 and a decompression chamber 38. The pump chamber 28 is surrounded by the diaphragm 3 (the abutment portion 31 and the folded portion 33) and the pump head 12.

Therefore, change in position of the diaphragm. 3 caused by its reciprocation with the piston 21, namely, change in position of the abutment portion 31 accompanying deformation of the folded portion 33 enables change (increase or decrease) in volume of the pump chamber 28.

The pump chamber 28 is connected to both the suction port 15 and the discharge port 16, and can temporarily store fluid sucked from the suction port 15. The decompression chamber 38 is connected to the vent hole 13 and can be depressurized by the decompression device.

In the diaphragm pump 1, the actuator 4 also includes a motor 40 as a driving source. In the present embodiment, the actuator 4 further includes the output shaft 42 as a movable member, in addition to the piston 21, the shaft 22 and the motor 40.

The motor 40 is a pulse motor (stepping motor). The motor 40 is provided on another axial side (back side) of the housing 2. The output shaft 42 is a screw shaft (feed screw). The output shaft 42 is connected to be interlocked with the rotation shaft of the motor 40.

The output shaft 42 is axially reciprocable and projected from the motor 40 into the housing 2. The output shaft 42 is disposed coaxially with the shaft 22 and has one axial end (front end) connected to another axial end (back end) of the shaft 22 via the shaft holder 29.

The actuator 4 can convert the rotational motion of the motor 40 into a linear motion of the output shaft 42 and the shaft 22 so that the output shaft 42, the piston 21, and the like can reciprocate the diaphragm 3 in the axial (back-and-forth) direction.

Figure 3:
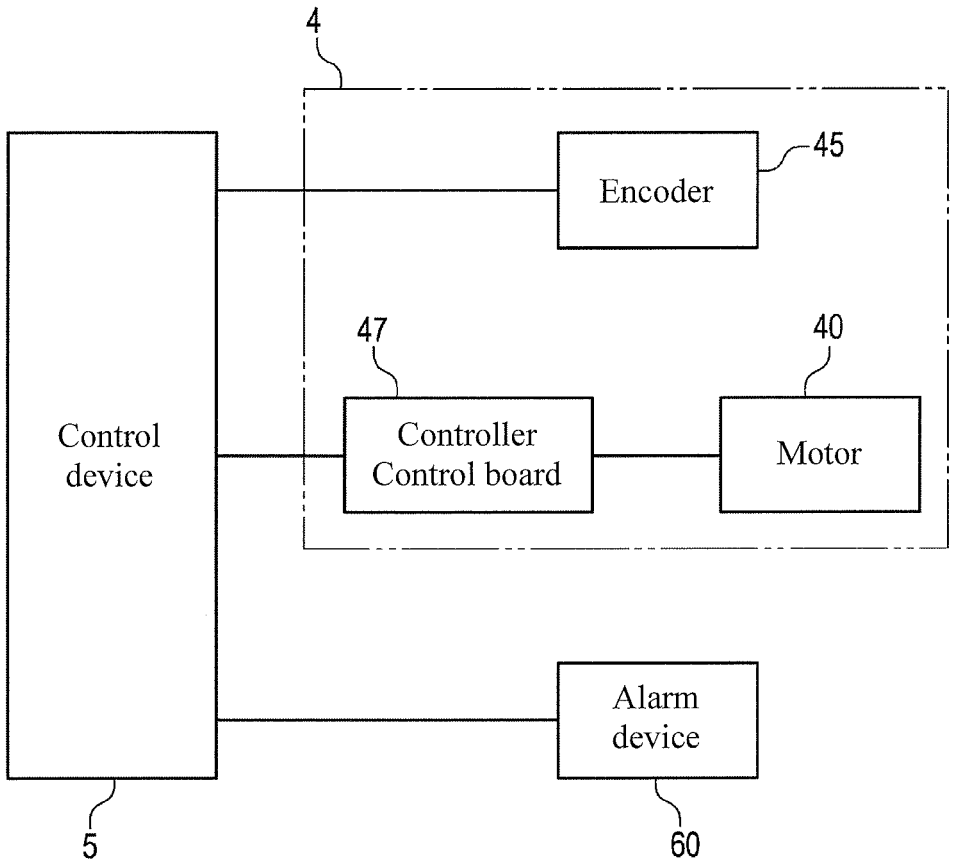
FIG. 3 is a block diagram of the diaphragm pump of FIG. 1.

The actuator 4 uses an encoder 45 (see FIG. 3). The encoder 45 is attached to the rotation shaft of the motor 40. The encoder 45 is used for drive control of the motor 40, and is configured to output signal pulses synchronized with the rotation of the motor 40.

The control device 5 is used for controlling the actuator 4 to move the diaphragm 3 forward or backward with respect to the origin P1. Note that the forward movement of the diaphragm 3 is the movement (advancing) thereof decreasing the volume of the pump chamber 28, and the backward movement thereof is the movement (retreating) thereof increasing the volume of the pump chamber 28.

As shown in FIG. 3, the control device 5 is electrically connected to the motor 40 via a controller (control board) 47 and also to the encoder 45. The control device 5 is configured to output driving signal pulses for the drive control of the motor 40.

To make the diaphragm pump 1 alternately perform a suction and a discharge for fluid transfer during its operation, the control device 5 can perform the driving control of the motor 40 to reciprocate the diaphragm 3 in the axial direction of the housing 2.

When the diaphragm pump 1 performs a suction, the motor 40 rotates in the negative direction to make the piston 21 move the diaphragm 3 backward to be displaced (from the position shown in FIG. 1 to the position shown in FIG. 2) to increase the volume of the pump chamber 28. At that time, the control device 5 controls opening of an on-off valve on the suction side and closing of an on-off valve on the discharge side. As a result, fluid is sucked into the pump chamber 28 through the suction port 15.

When the diaphragm pump 1 performs a discharge, the motor 40 rotates in the positive direction to make the piston 21 move the diaphragm. 3 forward to be displaced (from the position shown in FIG. 2 to the position shown in FIG. 1) to decrease the volume of the pump chamber 28. At that time, the control device 5 controls closing of the on-off valve on the suction side and opening of the on-off valve on the discharge side. As a result, the fluid is discharged from the pump chamber 28 through the discharge port 16. In the present embodiment, the diaphragm 3 at the completion of the discharge is located at the origin P1.

<Return-to-Origin Type 1>

In the diaphragm pump 1, the control device 5 is configured to actuate (i.e. rotate in the positive direction) the motor 40 (of the actuator 4) such that the diaphragm 3 moves forward, until hitting the housing 2 (the pump head 12) to bring the motor 40 into a first step-out.

Figure 4:
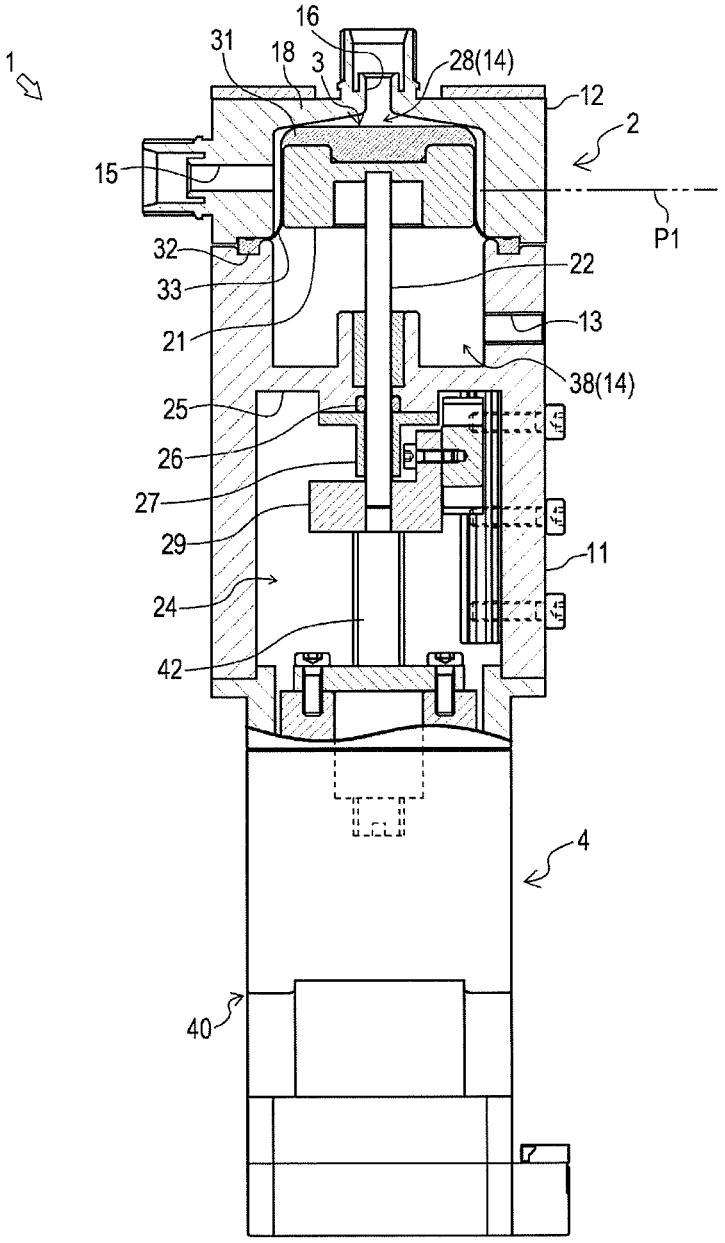
FIG. 4 is a side sectional view showing an example of a state of the diaphragm pump of FIG. 1 at the occurrence of hitting therein.

In the present embodiment, at the turn-on, the diaphragm pump 1 uses the motor 40 to make the abutment portion 31 of the diaphragm 3 hit the ceiling portion of the housing 2 (i.e. the lid portion 18 of the pump head 12), as shown in FIG. 4, so that the motor 40 falls into the first step-out (i.e. rotational deviation or idling).

The control device 5 is configured to detect the first step-out of the motor 40 of the actuator 4. In the present embodiment, the control device 5 can detect the first step-out caused by the abutment portion 31 of the diaphragm 3 hitting the lid portion 18 of the pump head 12.

For drive control of the motor 40, the control device 5 is configured to acquire signal pulses from the encoder 45, and based on the acquired signal pulses (esp. their number), detect a rotation amount (i.e. rotation angle) and the like of the motor 40 while it reciprocates the diaphragm 3.

While moving the diaphragm 3 forward by using the motor 40, the control device 5 grasps the occurrence of a deviation in rotation amount of the motor 40 when the abutment portion 31 hits the lid portion 18 of the pump head 12, as shown in FIG. 4.

More concretely, by comparing signal pulses from the encoder 45 with the drive signal pulses, the control device 5 grasps the occurrence of a deviation in rotation amount of the motor 40 (i.e. a difference from a rotation amount expected from the drive signal pulses). When determining that the deviation is equal to or greater than a first predetermined value, the control device 5 detects the first step-out of the motor 40.

When detecting the first step-out of the motor 40, the control device 5 stops activating the motor 40 and resets a position as the origin P1; the position is a predetermined first distance (in the back direction) from a position at which the diaphragm 3 hits the housing 2 in the reciprocating (back-and-forth) direction of the diaphragm 3 (i.e. from the inner surface of the lid portion 18).

In the present embodiment, the control device 5 resets the origin P1 each time the diaphragm pump 1 is turned on. Note that timing for resetting the origin P1 is not limited to the turn-on, but may be that for another event.

After resetting the origin P1, the control device 5 activates (the negative rotation of the motor of) the actuator 4 to move the diaphragm 3 backward to the origin P1. Then, the control device 5 starts the reciprocation of the diaphragm 3 after returning to the origin P1.

Figure 5:
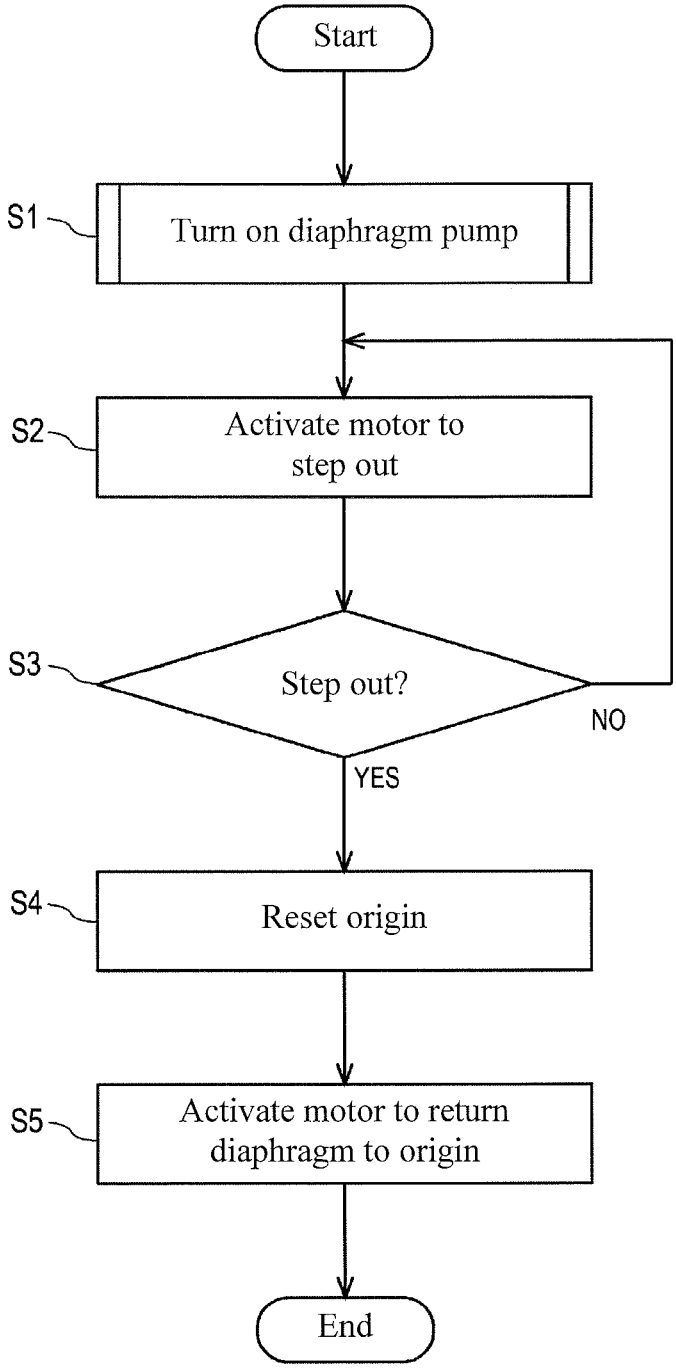
FIG. 5 is a flowchart of an example of a control in the diaphragm pump of FIG. 1.

As shown in FIG. 5, for example, after the diaphragm pump 1 is turned on (S1), the control device 5 activates the motor 40 to cause the first step-out (S2). The control device 5 then determines whether the motor 40 causes the first step-out (S3).

The control device 5 activates the motor 40, until detecting the occurrence of the first step-out of the motor 40. When detecting the occurrence of the first step-out, the control device 5 resets the origin P1 in accordance with the hitting position (S4). Thereafter, the control device 5 activates the motor 40 (of the actuator 4) such that the diaphragm. 3 is returned to the origin (S5).

While moving the diaphragm 3 backward to the origin P1, the control device 5 controls the on-off valve on the suction side to be opened and the on-off valve on the discharge side to be closed. As a result, fluid is sucked into the pump chamber 28 through the suction port 15.

The above-described configuration enables the diaphragm 3 to accurately return to the origin, which is peculiar to the diaphragm pump 1, before the diaphragm pump 1 starts to be used for the fluid transfer. Hence, the diaphragm pump 1 can enhance discharge accuracy. Further, the diaphragm pump 1 does not need the detector for the return-to-origin. This enables reduction in manufacturing costs of the diaphragm pump 1.

<Return-to-Origin Type 2>

Figure 6:
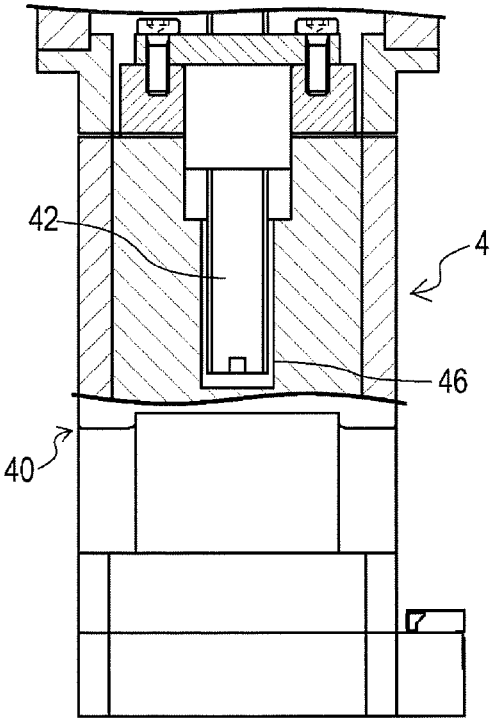
FIG. 6 is a partial sectional view of an actuator in the diaphragm pump of FIG. 1.

In the present embodiment, as shown in FIG. 6, the other axial end (back end) of the output shaft 42 of the actuator 4, which is the moving member, is put inside an axial recess 46 of the motor 40 in a reciprocable manner. Hence, to reset the origin P1, the control device 5 can use the output shaft 42 instead of the diaphragm 3.

Figure 7:
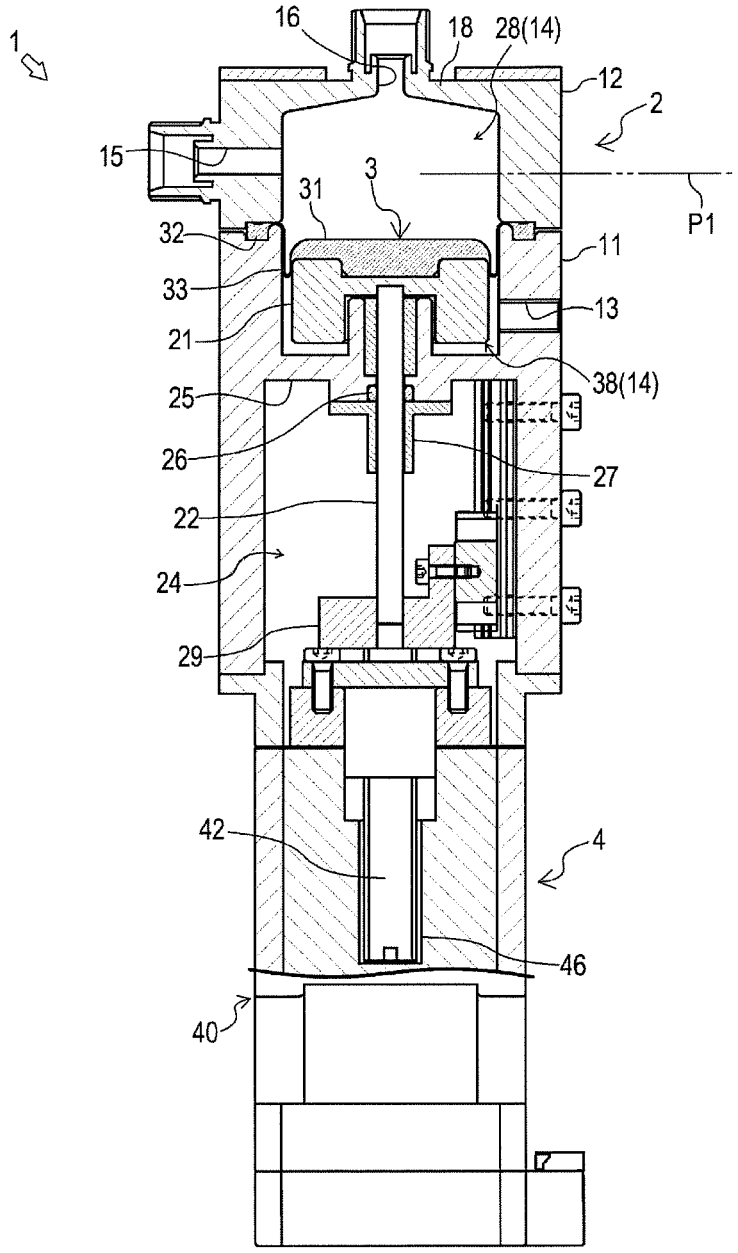
FIG. 7 is a side sectional view showing another example of the state of the diaphragm pump of FIG. 1 at the occurrence of hitting therein.

In this case, to bring the motor 40 into the first step-out, the control device 5 activates (the negative rotation of the motor 40 of) the actuator 4 such that the output shaft 42 moves backward, until hitting the recess 46 (specifically, the bottom thereof), as shown in FIG. 7; the control device 5 then detects the first step-out of the motor 40.

After the detection, the control device 5 resets a position as the origin P1; the position is a predetermined second distance (in the forward direction) from a position at which the output shaft 42 hits the recess 46 in the reciprocating direction of the output shaft 42. The control device 5 activates the motor 40 to move the output shaft 42 forward, and accordingly the diaphragm 3 forward to the origin P1.

<Return-to-Origin Type 3>

In the present embodiment, the shaft holder 29 of the actuator 4 is provided as the movable member, and is configured to be reciprocable integrally with the diaphragm 3 to move closer to or farther from the O-ring retainer 27 on the side of the housing 2. Hence, to reset the origin P1, the control device 5 can use the shaft holder 29.

Figure 8:
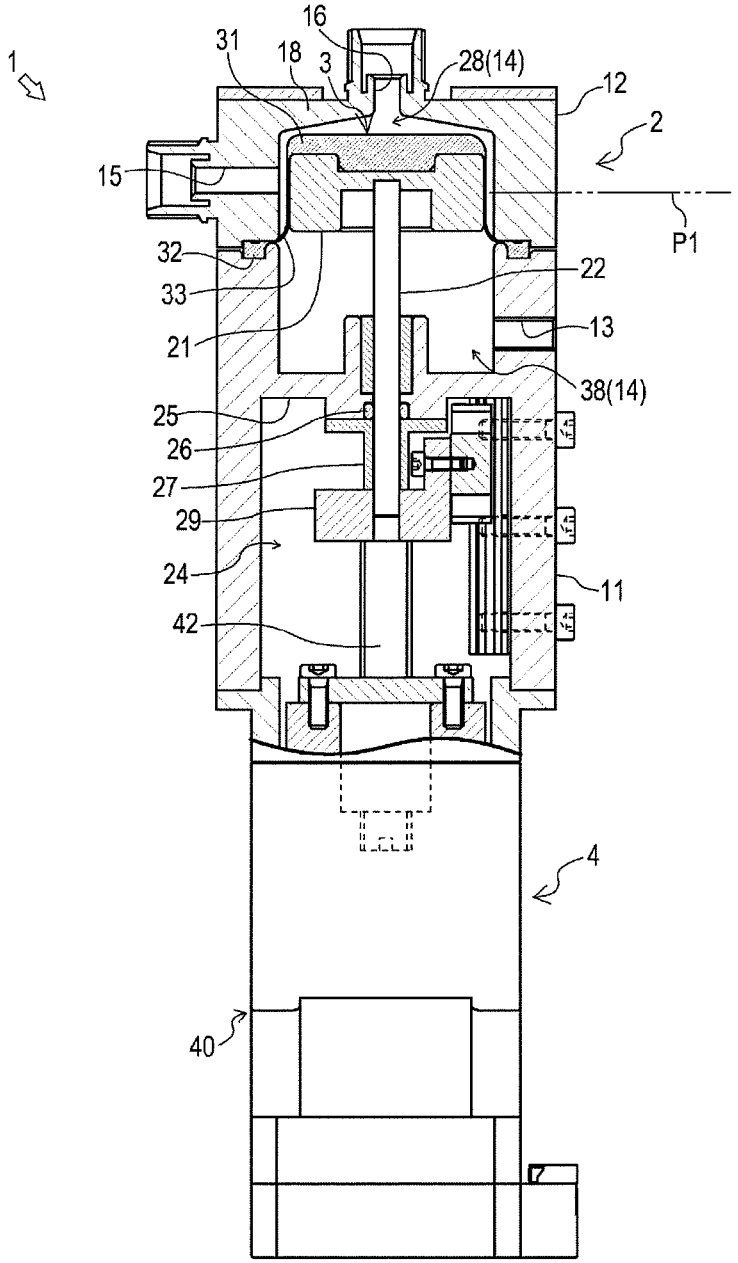
FIG. 8 is a side sectional view showing still another example of the state of the diaphragm pump of FIG. 1 at the occurrence of hitting therein.

In this case, to bring the motor 40 into the first step-out, the control device 5 activates (the positive rotation of the motor 40 of) the actuator 4 such that the shaft holder 29 moves forward, until hitting the O-ring retainer 27 (specifically, the back end thereof), as shown in FIG. 8. The control device 5 then detects the first step-out of the motor 40.

After the detection, the control device 5 resets a position as the origin P1; the position is a predetermined third distance (in the backward direction) from a position at which the shaft holder 29 hits the O-ring retainer 27 in the reciprocating direction of the output shaft 42. The control device 5 activates the motor 40 to move the shaft 22 forward, and accordingly the diaphragm 3 forward to the origin P1.

When this configuration is adopted, as shown in FIG. 8, it is necessary to provide the diaphragm 3 and the actuator 4 in the housing 2 such that the shaft holder 29 hits the O-ring retainer 27 before the diaphragm 3 hits the ceiling portion of the housing 2 (i.e. the lid portion 18 of the pump head 12).

<Error Detection>

In the present embodiment, the control device 5 is configured to grasp the position of the diaphragm 3 in the reciprocating direction. Specifically, the control device 5 can detect the rotation amount of the motor 40 by using the encoder 45, to grasp the position of the diaphragm 3 based on the detection result.

While returning the diaphragm 3 to the origin P1, and controlling the diaphragm pump to perform a suction, a discharge, and the like, the control device 5 stops the motor 40 (of the actuator 4), when determining, based on the position of the diaphragm 3, that the diaphragm 3 moves forward (advances) beyond the first predetermined amount.

The control device 5 also stops the motor 40 (of the actuator 4), when determining, based on the position of the diaphragm 3, that the diaphragm 3 moves backward (retreats) beyond the second predetermined amount. The first predetermined amount and the second predetermined amount are appropriately settable values and may be the same value or different values.

Specifically, during the return-to-origin of type 1, the control device 5 activates the motor 40 such that the diaphragm 3 moves forward, until hitting the lid portion 18 of the pump head 12; when determining that the diaphragm 3 has moved forward beyond the first predetermined amount before the hitting, the control device 5 stops the motor 40, and then, the diaphragm. 3 stops moving forward.

In addition, the control device 5 is configured to detect a second step-out of the motor 40 of the actuator 4. In the present embodiment, the control device 5 detects the second step-out when the reciprocation of the diaphragm 3 is inhibited due to high viscosity of the fluid sucked into the pump chamber 28, or when the reciprocation of the diaphragm 3 is hindered due to dust or the like being caught between the shaft 22 and the partition 25.

While returning the diaphragm 3 to the origin P1, and controlling the diaphragm pump to perform a suction, a discharge, and the like, the control device 5 compares the signal pulses from the encoder 45 with the drive signal pulses to grasp the occurrence of a deviation of the rotation amount of the motor 40 (a difference from the rotation amount expected from the drive signal pulses). When determining that the deviation is equal to or greater than a second predetermined value, the control device 5 detects the second step-out of the motor 40. Note that the second predetermined value is set to a value greater than the first predetermined value for detecting the first step-out of the motor 40.

The control device 5 stops the motor 40 (of the actuator 4), when detecting the second step-out of the motor 40.

While the control device 5 activates the motor 40 to move the diaphragm 3 backward to the reset origin P1, the control device 5 stops the motor 40, when detecting the second step-out based on that the backward movement of the diaphragm 3 has been hindered by some cause (e.g., high viscosity of the fluid sucked into the pump chamber 28 from the suction port 15); then, the diaphragm 3 stops moving backward.

In the present embodiment, the diaphragm pump 1 is provided with an alarm device 60 for issuing an alarm when the actuator 4 (i.e. the motor 40) stops. As described above, the control device 5 is configured to stop the motor 40 (of the actuator 4) and activate the alarm device 60 at the following cases: when determining that the diaphragm 3 has moved forward beyond the first predetermined amount; when determining that the diaphragm 3 has moved backward beyond the second predetermined amount; and when detecting the second step-out.

The alarm device 60 only has to be a device capable of alarming the stoppage of the actuator 4 to an operator of the diaphragm pump 1, and can, for example, be a device capable of displaying an alarm indication, a device capable of outputting an alarm sound, or a device capable of displaying an alarm indication and outputting an alarm sound.

This configuration in the present embodiment enables the operator to detect occurrence of an abnormality in the diaphragm 3 and prevent the driving portion in the diaphragm pump 1 from being damaged due to the abnormality. In particular, the alarm device 60 makes it possible to immediately notify the occurrence of the abnormality of the diaphragm 3.

In the embodiment described above, the structural configuration and functional configuration of the actuator 4 and the control device 5 can be appropriately changed in accordance with the gist of the present invention. For example, the method of detecting the first step-out in the return-to-origin is not limited to the method shown as the return-to-origin of types 1 to 3, and in short, the control device 5 only has to be a device capable of detecting the first step-out by moving the diaphragm 3 or the movable member forward or backward until the diaphragm 3 or the movable member hits the housing 2 or the stationary member. In addition, the motor 40 may be a motor other than a pulse motor (stepping motor).

DESCRIPTION OF REFERENCE SIGNS

1: diaphragm pump; 2: housing; 3: diaphragm; 4: actuator; 5: control device; 27: O-ring retainer (stationary member); 28: pump chamber; 29: shaft holder (movable member); 40: motor; 42: output shaft (movable member); 60: alarm device.

What is claimed is:

1. A diaphragm pump for transferring a fluid, comprising:

a housing that accommodates a stationary member;

a diaphragm disposed to form a pump chamber in the housing, and reciprocable with respect to an origin to change the volume of the pump chamber;

an actuator including a motor as a driving source and a movable member interlocked with the diaphragm, and configured to reciprocate the diaphragm; and a control device for controlling the actuator to reciprocate the diaphragm, configured to:

detect a first step-out of the motor;

drive the actuator to move the diaphragm or the movable member until the diaphragm or the movable member hits the housing or the stationary member to bring the motor into the first step-out;

reset a position as the origin, when detecting the first step-out of the motor, the position being a predetermined distance in a reciprocating direction of the diaphragm from a position at which the diaphragm or the movable member hits the housing or the stationary member; and activate the actuator after resetting the origin, to move the diaphragm to the origin.

2. The diaphragm pump according to claim 1, wherein the motor is a stepping motor.

3. The diaphragm pump according to claim 1, wherein the control device is configured to:

grasp a position of the diaphragm in the reciprocating direction; and stop the actuator, when determining, from the position of the diaphragm, that the diaphragm moves forward beyond a first predetermined amount or backward beyond a second predetermined amount.

4. The diaphragm pump according to claim 3, comprising an alarm device that issues an alarm when the actuator is stopped.

* * * * *